US008196663B2

(12) United States Patent
Bolding

(10) Patent No.: US 8,196,663 B2
(45) Date of Patent: Jun. 12, 2012

(54) DEAD STRING COMPLETION ASSEMBLY WITH INJECTION SYSTEM AND METHODS

(75) Inventor: Jeffrey L. Bolding, Kilgore, TX (US)

(73) Assignee: Baker Hughes Incorporated, Houston, TX (US)

( * ) Notice: Subject to any disclaimer, the term of this patent is extended or adjusted under 35 U.S.C. 154(b) by 454 days.

(21) Appl. No.: 12/405,227

(22) Filed: Mar. 16, 2009

(65) Prior Publication Data

US 2009/0242208 A1 Oct. 1, 2009

Related U.S. Application Data

(60) Provisional application No. 61/039,245, filed on Mar. 25, 2008.

(51) Int. Cl.
*E21B 43/12* (2006.01)

(52) U.S. Cl. ..... 166/310; 166/371; 166/242.1

(58) Field of Classification Search ..... 166/305.1, 166/243, 242.1, 371, 310, 332.5, 242.8
See application file for complete search history.

(56) References Cited

U.S. PATENT DOCUMENTS 4,298,066 A * 11/1981 Colonna et al. ..... 166/300
4,545,731 A 10/1985 Canalizo et al.
5,117,913 A 6/1992 Themig
5,842,520 A 12/1998 Bolin
6,880,639 B2 4/2005 Rhodes et al.
7,409,998 B2 8/2008 Campbell
2004/0216886 A1 11/2004 Rogers, Jr.
2005/0155764 A1 7/2005 Goode et al.
2007/0158074 A1 7/2007 Campbell

FOREIGN PATENT DOCUMENTS

WO 01/44618 6/2001

OTHER PUBLICATIONS

J. Rignol, et al., "Using Coiled Tubing Equipment to Run Complex Jointed Tubing Velocity Strings", SPE 93586, 2005.
S. D. Maddox, "Hydraulic Workover Techniques: Their Versatility and Applications", SPE 27605, 1994.
Edward J. Hutlas, et al., "A Practical Approach to Removing Gas Well Liquids", Journal of Petroleum Technology, pp. 916-922, Aug. 1972.
R.L. Christiansen, et al., "Liquid Lifting From Natural Gas Wells: Tubing-Casing Junction", SPE 96938, 2005.
Mike Eberhard, et al., "Application of Flow-Thru Composite Frac Plugs in Tight-Gas Sand Completions", SPE 84328, 2003.

* cited by examiner

*Primary Examiner* — David Andrews
(74) *Attorney, Agent, or Firm* — E. Randall Smith; Jones & Smith, LLP

(57) ABSTRACT

In some embodiments, apparatus useful for providing fluids or equipment into a subterranean well through a production tubing and associated dead string includes an injection system that is movable into and out of the well without removing the production tubing. The injection system includes a stopper that forms the seal that creates the dead string.

31 Claims, 7 Drawing Sheets

DEAD STRING COMPLETION ASSEMBLY WITH INJECTION SYSTEM AND METHODS

This application claims priority to U.S. provisional patent application Ser. No. 61/039,245 filed Mar. 25, 2008, entitled "Deadstring Completion Assembly and Methods with Integral Injection System", the disclosure of which is hereby incorporated by reference herein in its entirety.

FIELD OF THE INVENTION

The present disclosure relates generally to dead string completion technology and, more particularly, apparatus and methods relating to the injection of fluid or insertion of equipment into a subterranean well through a dead sting assembly.

BACKGROUND OF THE INVENTION

In typical hydrocarbon recovery completion systems, the production tubing is suspended in the casing and terminates above the top perforation. By terminating the production tubing above the top perforation, such as at 100 feet or more, the cased section of the well adjacent to the perforations has a larger diameter than the cased section adjacent to the production tubing. The larger diameter of the cased section adjacent to the perforations severely reduces the velocity of the production liquids exiting the perforations, which in turn may create liquid loading, a situation where the liquids settle at the bottom of the casing because the velocity is not sufficient enough to lift the fluids. Often, extremely long perforated casing intervals, sometimes 3,000 feet or more, are exposed to longer sections of low velocities, again increasing the inevitable liquid loading phenomena.

In recent years, "dead string" completions have been embraced by many operators in order to combat the phenomena of liquid loading. The typical dead string completion consists of a perforated sub connected to the bottom of the production tubing, and a tubing extending from the perforated sub down into the perforated casing interval. The tubing extending down from the perforated sub is plugged, hence the term "dead string", and can have a larger or smaller diameter than that of the production tubing. As such, the dead string portion essentially reduces the flow area within the adjacent casing interval, thereby increasing the velocity of the fluid flow and enhancing hydrocarbon production over the life cycle of the well.

Current dead string assemblies are also often used to introduce chemicals down hole. These chemicals, such as scale inhibitors, are delivered from the surface to the perforated sub and ultimately to the perforated casing to perform their desired function. Various techniques have been used and proposed for delivering the chemicals. For example, chemicals have been introduced by "strapping" a capillary tubing to the outer diameter of the production tubing with bands while a workover rig is installing the production tubing. The capillary tubing is coupled to a cross over sub to introduce the chemicals to the inside diameter of the dead string through a chemical injection valve and, hopefully, out into the annulus between the dead string and the casing to treat the well across the entire perforated interval.

Presently known techniques for providing chemicals (or any other desired liquids, gasses, equipment or a combination thereof) via a dead string completion assembly may have one or more drawbacks. For example, it may not be possible to snub the well live due to the capillary string and bands (i.e., strapping) on the outer diameter of the production tubing. In such instance, in order to accommodate the strapping of the capillary tubing to the production tubing, the well must be killed and heavy hydrostatic fluids, which may cause damage to the formation, may need to be used. For another possible example, should the capillary become plugged or the chemical injection system become inoperable, the well must be killed again in order to pull the entire production string for repair and/or replacement of the capillary line. For yet another potential example, in the case of backside capillary lines, the strapped capillary must penetrate the tubing hanger—which can be a costly endeavor.

It should be understood that the above-described discussion is provided for illustrative purposes only and is not intended to limit the scope or subject matter of the appended claims or those of any related patent application or patent. Thus, none of the appended claims or claims of any related application or patent should be limited by the above discussion or construed to address, include or exclude the cited examples, features and/or disadvantages, merely because of the mention thereof above.

Accordingly, there exists a need for improved systems, apparatus and methods capable of injecting any desired fluid (s) or inserting equipment into a subterranean well through a dead string completion assembly having one or more of the attributes or capabilities described below or evident from the appended drawings.

BRIEF SUMMARY OF THE DISCLOSURE

In some embodiments, the present disclosure involves apparatus useful for providing fluids into a subterranean well through a hydrocarbon recovery system deployable in the well. The hydrocarbon recovery system may include at least one production tubing and associated dead string portion. The dead string portion is located below the production tubing and both the production tubing and dead string portion have at least one bore extending longitudinally therethrough. The production tubing includes at least one perforated portion that allows the entry of fluids into the bore thereof from the well when the production tubing is deployed in the well. The apparatus of these embodiments includes an injection system releasably engageable with the hydrocarbon recovery system and configured to be movable into and out of the well and the production tubing at least substantially independent of movement of the hydrocarbon recovery system.

The injection system of these embodiments includes at least one delivery tubing and stopper. The delivery tubing has an outer diameter that is smaller than the inner diameters of the production tubing and dead string portion. The stopper is connected with the delivery tubing and configured to prevent fluid flow between the respective bores of the production tubing and dead string portion when the injection system is engaged with the hydrocarbon recovery system. The delivery tubing extends below the stopper and allows fluid to be ejected therefrom at a desired location within or below the dead string portion when the injection system is engaged with the hydrocarbon recovery system.

When the hydrocarbon recovery system is deployed in the well, the injection system of these embodiments may be engaged and disengaged with and removable from the hydrocarbon recovery system without removing the hydrocarbon recovery system from the well. Engagement of the injection system with the hydrocarbon recovery system fluidly isolates the production tubing and dead string portion, while disengagement thereof allows fluid communication between the respective bores of the production tubing and the dead string portion.

In some embodiments, the present disclosure includes a delivery tubing configured to allow fluid to be ejected therefrom into the production tubing at a location above the stopper when the injection system is engaged with the hydrocarbon recovery system in the well.

The present disclosure also includes some embodiments which involve a chemical injection system capable of providing chemicals into a subterranean well having at least one connected production tubing, perforated sub, dead string and landing nipple. The chemical injection system includes at least one interconnected upper and capillary tubing, stopper and injector. The upper capillary tubing is in fluid communication with a chemical supply source. The stopper is releasably sealingly engageable within the landing nipple and capable of releasably fluidly isolating the respective bores of the production tubing and dead string. The lower capillary tubing is in fluid communication with the upper capillary tubing and at least partially insertable into the bore of the dead string. The injector is disposed at or proximate to the lower end of the lower capillary tubing and is positionable and capable of ejecting chemicals supplied through the upper and lower capillary tubings below the top of the dead string. The upper and lower capillary tubings, stopper and injector are together insertable into and removable from the bore of the production tubing without removing the production tubing from the well. There are also embodiments of the present disclosure that involve apparatus useful for providing equipment into a subterranean well through a hydrocarbon recovery system deployable in the well. The hydrocarbon recovery system may include at least one production tubing and associated dead string portion. The dead string portion is located below the production tubing and both the production tubing and dead string portion have at least one bore extending longitudinally therethrough. The production tubing includes at least one perforated portion that allows the entry of fluids into the bore thereof from the well when the production tubing is deployed in the well.

In these embodiments, an injection system is releasably engageable with the hydrocarbon recovery system and configured to be movable into and out of the well and the production tubing at least substantially independent of movement of the hydrocarbon recovery system. The injection system includes at least one delivery tubing having upper and lower ends and an outer diameter that is smaller than the inner diameter of the production tubing and dead string portion. The delivery tubing is capable of carrying at least one item of equipment proximate to its lower end. At least one stopper is connected with the delivery tubing and configured to prevent fluid flow between the respective bores of the production tubing and dead string portion when the injection system is engaged with the hydrocarbon recovery system. The delivery tubing extends a desired distance below the stopper and is capable of positioning the equipment carried thereby at a location within the dead string portion or below the dead string portion when the injection system is engaged with the hydrocarbon recovery system in the well. When the hydrocarbon recovery system is deployed in the well, the injection system may be engaged and disengaged with and removable from the hydrocarbon recovery system without removing the hydrocarbon recovery system from the well. Engagement of the injection system with the hydrocarbon recovery system fluidly isolates the production tubing from the dead string portion and disengagement of the injection system from the hydrocarbon recovery system allows fluid communication between the production tubing and the dead string portion.

In some embodiments, the present disclosure involves a method of providing chemicals into a subterranean well having a hydrocarbon recovery system disposed therein. The hydrocarbon recovery system includes at least one interconnected production tubing, dead string portion and seat nipple. The dead string portion is disposed down hole of the production tubing. The production tubing, dead string portion and seat nipple each have a bore extending longitudinally therethrough. The production tubing including at least one perforated portion or sub that allows the entry of fluids into the bore of the production tubing from the well.

The method of these embodiments includes inserting an injection system into the production tubing from the surface, the injection system including at least one delivery tubing and stopper. At least substantially simultaneously, the stopper is seated within the seat nipple, fluidly isolating the respective bores of the production tubing and dead string at the location of the stopper, and at least one fluid ejection point is positioned at a desired location either within the bore of the dead string or below the lower end of the dead string. Chemicals are ejected from the delivery tubing at a desired location either within the bore of the dead string or below the lower end of the dead string. An overpull is applied to the delivery tubing and the fluid injection system is removed from the hydrocarbon recovery system and well, fluidly connecting the respective bores of the production tubing and dead string. The injection system is thus removable from the well without removing the hydrocarbon recovery system from the well.

Accordingly, the present disclosure includes features and advantages which are believed to enable it to advance dead string completion technology. Characteristics and potential advantages of the present disclosure described above and additional potential features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
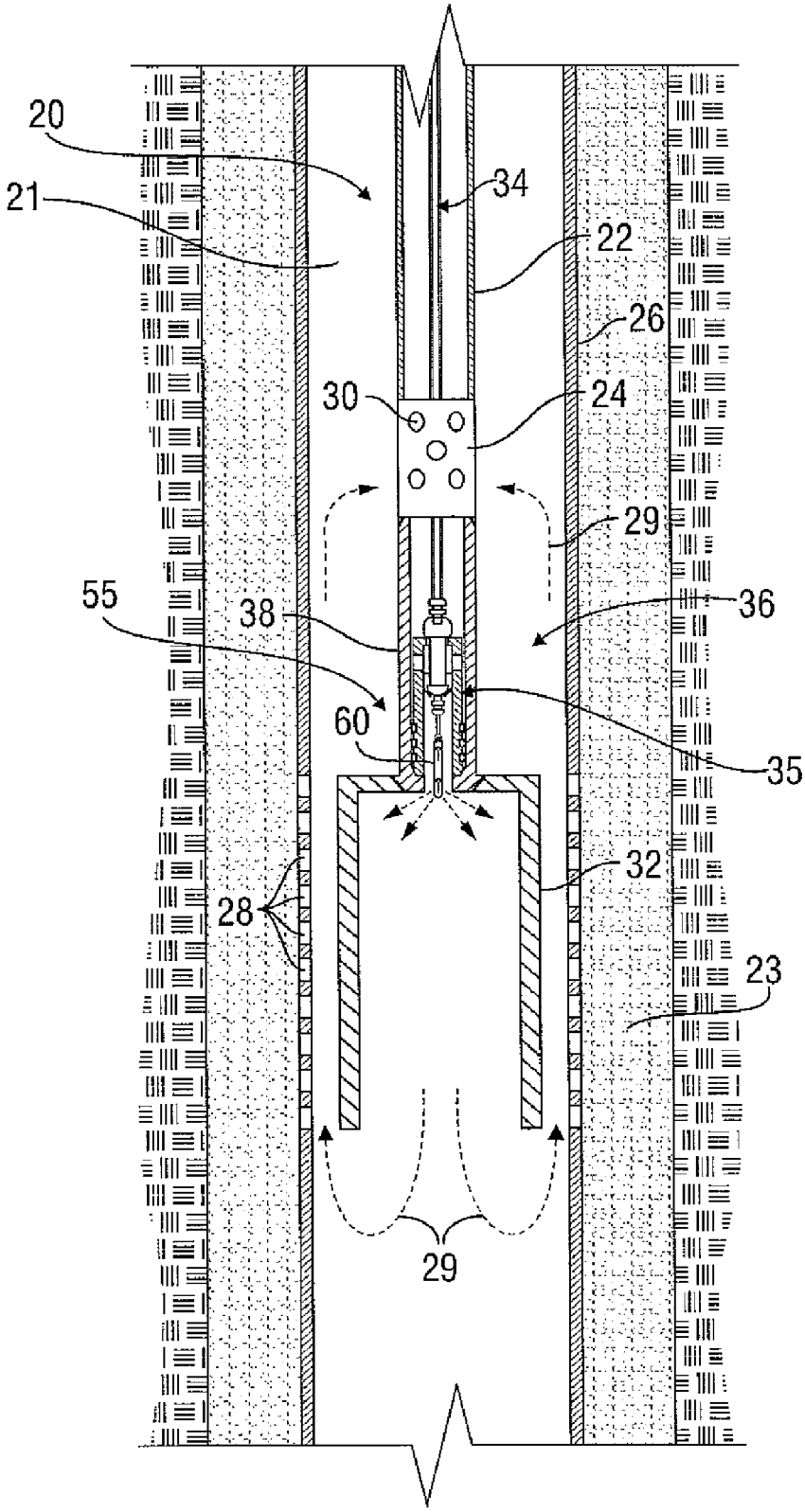
FIG. 1 is a partial cross-sectional view of an example hydrocarbon recovery system disposed in a well bore and incorporating an injection system in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application, any patent granted hereon or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring initially to FIG. 1, an example hydrocarbon recovery system 20 is shown deployed in a subterranean well bore 21. The illustrated well bore 21 includes a casing 26 emplaced with cement 23 and perforated with perforations 28. The perforations 28 may run along the casing 26 at any desired interval. Such an interval, for example, could be from 100 to 3000 feet or more depending on the length of the hydrocarbon-bearing formation(s). The casing 26 may have been perforated by a variety of methods as would be appreciated by one of ordinary skill in the art. It should be noted that the use of a cased well bore 21 is provided for illustrative purposes only, as the subject matter of the present disclosure is applicable in any other suitable downhole environment, such as open well bores, as would be recognized by one of ordinary skill in the art.

The hydrocarbon recovery system 20 includes a production tubing 22 along with a perforated sub, or perforated portion, 24 and a dead string, or dead string portion, 32 run down hole inside the well bore 21. The production tubing 22, perforated sub 24 and dead string 32 are constructed, configured and operate as is and becomes known in the art. Any suitable attachment mechanism may be utilized for connecting the production tubing 22, perforated sub 24 and dead string 32.

The perforated sub 24 is shown attached to the end of the production tubing 22 and the dead string 32 attached below the perforated sub 24. A plurality of perforations 30 are located in the perforated sub 24 and allow for the flow of fluid, such as production fluids, into the production tubing 22, as understood by those skilled in the art. However, the perforations 30 may be formed directly into the production tubing 22 or other component, alleviating the need for a separate perforated sub 24 . Likewise, the dead string portion 32 may be an extension of the production tubing 22, or have any other configuration suitable to serve as a dead string, as is and becomes known. Although not illustrated, an "X" nipple may be run on top of the perforated sub 24 for any number of reasons, such as, for example, sealing the production tubing 22 during retrieval operations, or for future installation of a plunger lift bumper spring (not shown), as understood by those skilled in the art.

In FIG. 1, the perforated sub 24 is shown positioned in the well bore 21 at a location above the perforations 28 in the casing 26. In other examples, the perforated sub 24 could be located along the perforations 28, with the goal that all fluids and gases move up or cross ways, but not downward. Thus, if the perforated sub 24 was adjacent to the middle of the perforations 28, fluids from the upper most perforations 28 would possibly have to travel downward to reach the perforated sub 24, which should preferably be avoided in the illustrated example. Also in this example, the dead string 32 is shown extending from the top to the bottom of the illustrated perforations 28 in the casing 26. As such, the exemplary dead string 32 may extend, for example, a length of 3,000 foot or more. However, those skilled in the art realize the dead string 32 may extend any length along one or more sets of perforations 28, as desired.

The above-referenced components and the operation thereof are known in the art and may have any suitable form, construction and configuration. Moreover, the above-referenced components and the operation thereof are not limiting upon the present invention or the appended claims. If desired, different or additional components, as are and become known in the art, may be used.

Figure 9:
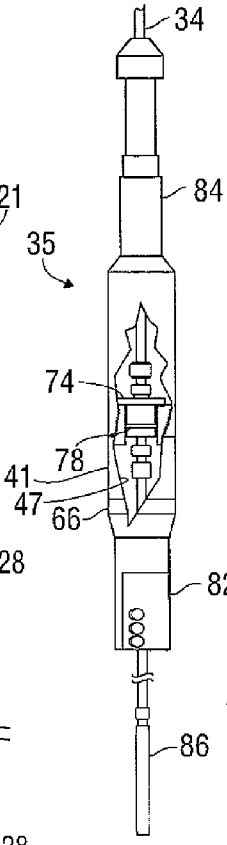
FIG. 9 is a partial cut-away view of an embodiment of an injection system in accordance with the present invention carrying an item of equipment instead of an injector.
Figure 10:
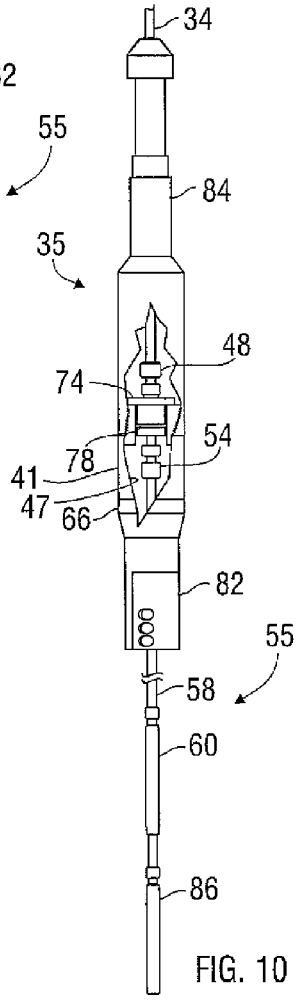
FIG. 10 is a partial cut-away view of an embodiment of an injection system in accordance with the present invention carrying an item of equipment in addition to an injector.

Now in accordance with an embodiment of the present invention, referring still to FIG. 1, an injection system 36 is shown run inside the internal bore of production tubing 22. The exemplary system 36 is releasably engageable with the hydrocarbon recovery system 20 and capable of injecting fluid therethrough into the dead string portion 32 and/or well bore 21. The fluid may be any desired treatment or other chemical(s), or any other one or more liquid, gas or fluid/ particle mixture. It should be noted, in other embodiments, the present disclosure involves the injection of fluids (not shown) above the dead string portion 32. In yet other embodiments, such as shown in FIGS. 9 and 10, the present disclosure involves systems 36 capable of inserting equipment 86 into the hydrocarbon recovery system 20. For example, the system 36 may carry any desired equipment 86, such as sensors, gages, fiber optics or electrical conductors, that may be used to perform one or more downhole operation. Accordingly, neither the type of "fluid" that is deliverable through the system 36, the type of equipment that may be carried by the system 36 nor any other characteristics thereof is limiting upon the present disclosure or the appended claims.

The illustrated injection system 36 includes at least one interconnected delivery tubing 34, such as capillary or coiled tubing, and at least one stopper 35 associated therewith. Fluid may be ejectable from the tubing 34 in any suitable manner. Typically, fluid may be ejected at one or more injection or ejection point at or proximate to the lower end 55 of the tubing 34. For example, the tubing 34 may be open-ended, or include one or more fluid ejection orifice (not shown), or one or more jetting, back pressure, check valve or other device (not shown) useful to assist in ejecting fluid as desired. In the illustrated embodiment, at least one injector 60 is shown disposed proximate to the lower end 55 of the delivery tubing 34 to assist in ejecting fluid therefrom. It should be understood, however, that the use of an injector 60 is not required for every embodiment.

The outer diameters of the illustrated tubing 34, stopper 35 and injector 60 (if included), as well as any equipment (not shown) that may be carried by the tubing 34 are typically all smaller than the inner diameter of the production tubing 22, perforated portion 24 and, in the illustrated embodiment, the dead string portion 32, so that the injection system 36 is capable of being moved into and out of the hydrocarbon recovery system 20 at least substantially independent of movement of the system 20. In this embodiment, removal of the injection system 36 from the hydrocarbon recovery system 20 (i) allows the insertion of other equipment or tools (not shown) as desired into the production tubing 22 or the performance of other functions in the well, such as conducting a gage ring run, production logging and total depth tagging, and (ii) allows the components of the injection system 36 to be repaired, replaced, maintained or reconfigured, such as, for example, to clear a blockage therein or modify the deployed positioning of the injector 60, as will be described further below, all without having to remove the production tubing 22 from the well bore 21, killing the well or employing a workover rig.

Still referring to FIG. 1, the exemplary stopper 35 is capable of preventing fluid flow between the respective bores of the production tubing 22 and dead string portion 32 when the injection system 36 is engaged with the hydrocarbon recovery system 20. By fluidly isolating the dead string 32 from the production tubing 22 (and perforated sub 24), the exemplary stopper 35 essentially causes the dead string portion 32 to function as a dead string. Since the illustrated stopper 35 is coupled to the delivery tubing 34 and thus integral with the injection system 36, disengagement of the system 36 from the hydrocarbon recovery system 20 removes the obstruction or seal caused by the stopper 35, effectively opening the dead string and allowing communication between the respective bores of the production tubing 22 and the dead string 32.

Figure 5:
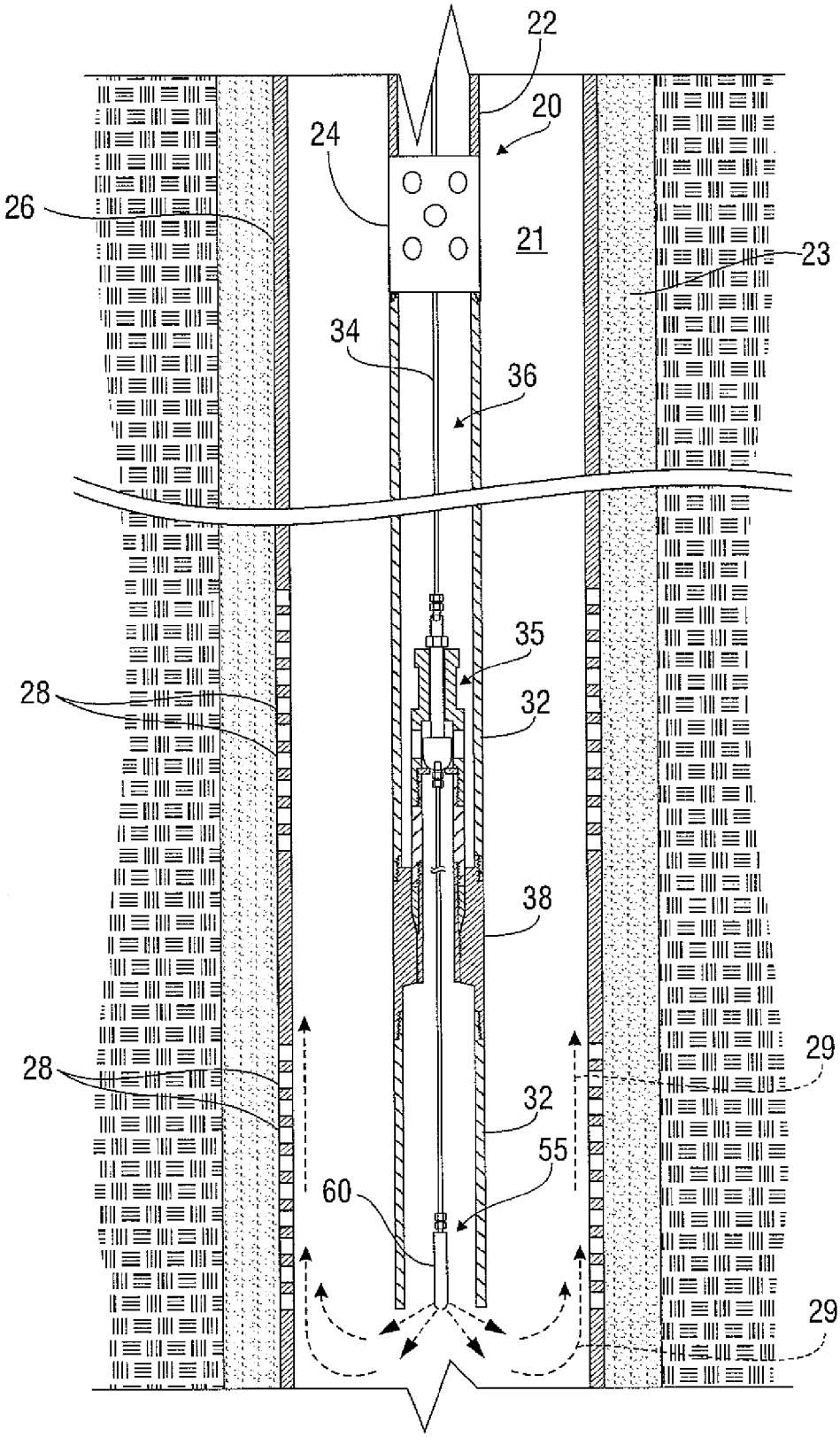
FIG. 5 is a partial cross-sectional view of the exemplary injection system of FIG. 3 shown deployed in an example hydrocarbon recovery system disposed in a well bore in accordance with an exemplary embodiment of the present disclosure.
Figure 8:
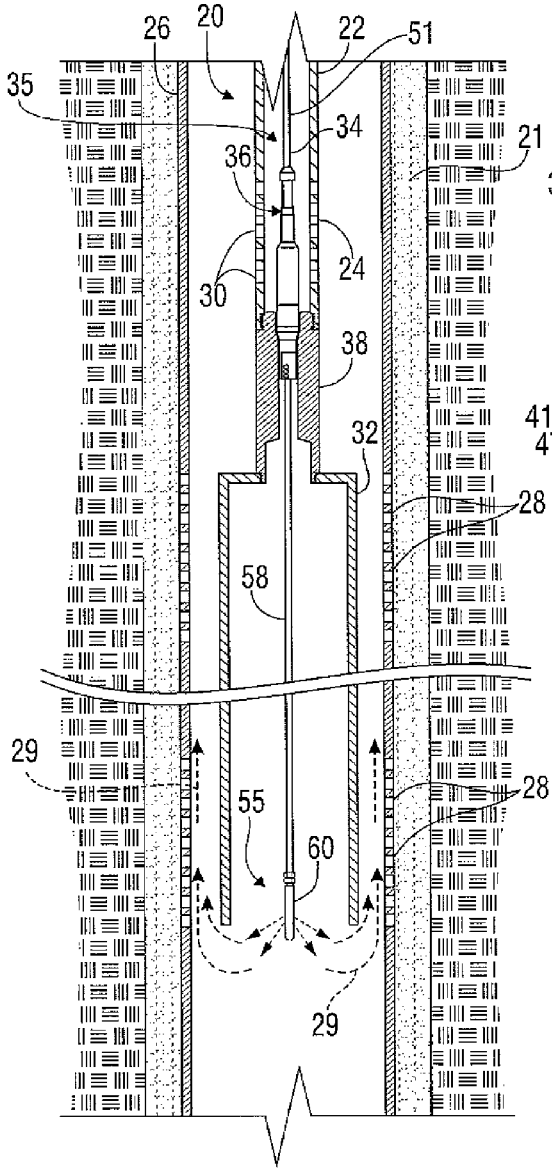
FIG. 8 is a partial cross-sectional view of the exemplary injection system of FIG. 6 shown deployed in an example hydrocarbon recovery system disposed in a well bore in accordance with an exemplary embodiment of the present disclosure.

The illustrated injector 60 is fluidly coupled to the delivery tubing 34 at a desired location below the stopper 35 and positionable at a desired location within or down hole of the dead string portion 32 when the system 36 is deployed. In this embodiment, the injector 60 is shown positioned near the top of the dead string 32. In the example of FIG. 5, the injector 60 is shown positioned at the lower end of the dead string 32 and, in the embodiment of FIG. 8, below the lower end of the dead string 32. The exemplary injector 60, when included, is thus capable of ejecting fluid from the delivery tubing 34 at any desired location within or below the dead string 32. As such, chemicals, such as scale inhibitors, foamers or other fluids or fluid/particle mixtures, may be injected downhole via the delivery tubing 34 and released at a desired location below the stopper 35 via the injector 60. Arrows 29 illustrate the path of the fluids exiting the example injection system 36. As such, the well bore 21 may be treated from the bottom perforation 28 up as the injected chemicals travel up the annulus between the dead string 32 and the well bore 21 along the perforations 28, thereafter entering the sub perforations 30 and traveling back up through production tubing 22. In other embodiments, the injector 60 (or other fluid ejection device or feature) may be positioned, or fluidly coupled to the delivery tubing 34, at a desired location above the stopper 35 and positionable at a desired location within the production tubing 22 when the system 36 is deployed.

Figure 2:
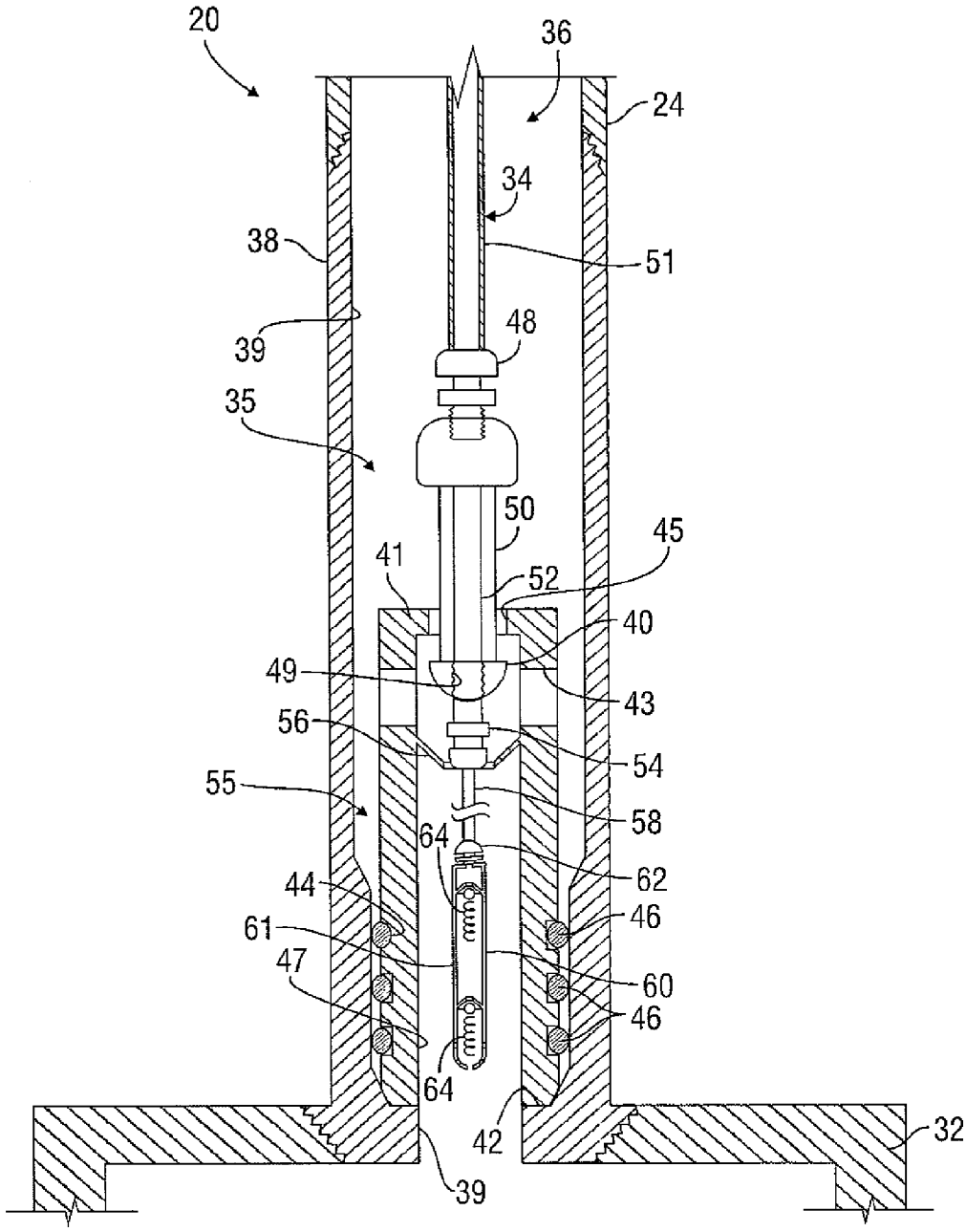
FIG. 2 is a partial cross-sectional view of the exemplary injection system of FIG. 1 in accordance with an embodiment of the present disclosure.

Any suitable technique and components may be included for releasably sealingly engaging the injection system 36 with the hydrocarbon recovery system 20. In the embodiment of FIG. 2, the injection system 36 is releasably sealingly engageable with a seat, or landing, nipple 38 shown attached to the bottom of the perforated sub 24. However, the seat nipple 38 may be provided at any desired location relative to the production tubing 22 (FIG. 1) and dead string 32. For example, depending upon the configuration of the production tubing 22 and dead string 32, the seat nipple 38 may be connected in the production tubing 22 at a desired position below the perforations 30, or at a desired position in the dead string 32. In the embodiment of FIG. 5, for example, the seat nipple 38 is connected deep along the length of the dead string portion 32, which has an outer diameter equal to that of the production tubing 22. Further, although a seat nipple 38 is provided, those ordinarily skilled in the art will appreciate that a variety of nipples or other components or features may instead be utilized.

The stopper 35 and injector 60 (when included) may have any suitable construction, configuration, form and operation. For example, referring to the embodiment FIG. 2, the injector 60 may be an injection mandrel 61 that includes one or more check valves 64 within its inner bore to prevent fluids from traveling up the injector 60. If desired, the injector 60 may be constructed and operate as disclosed in U.S. Pat. No. 6,880,639 entitled "Downhole Injection System" and issued on Apr. 19, 2005, which is commonly owned by the assignee of the present invention, BJ Services Company of Houston, Tex. and is hereby incorporated by reference in its entirety. For another example, the injector 60 may be a dissolvable device, such as a one-way aluminum mandrel (not shown). For yet another example, the injector 60 may include a single barrier check-valve, such as a ball-seat arrangement.

Still referring to the embodiment of FIG. 2, the illustrated stopper 35 includes a housing 41 through which the delivery tubing 34 extends or fluidly connects and which lands inside the seat nipple 38. In this example, the lower inner bore of seat nipple 38 includes a shoulder 42 upon which the housing 41 (as well as other equipment) may land. Once the illustrated housing 41 is inserted into the nipple 38, the bottom end of housing 41 rests atop the shoulder 42, thereby setting the housing 41 in the desired location. In other embodiments, different configurations of landing mechanisms and techniques may be utilized such as, for example, locking profiles and/or locking dogs.

Figure 3:
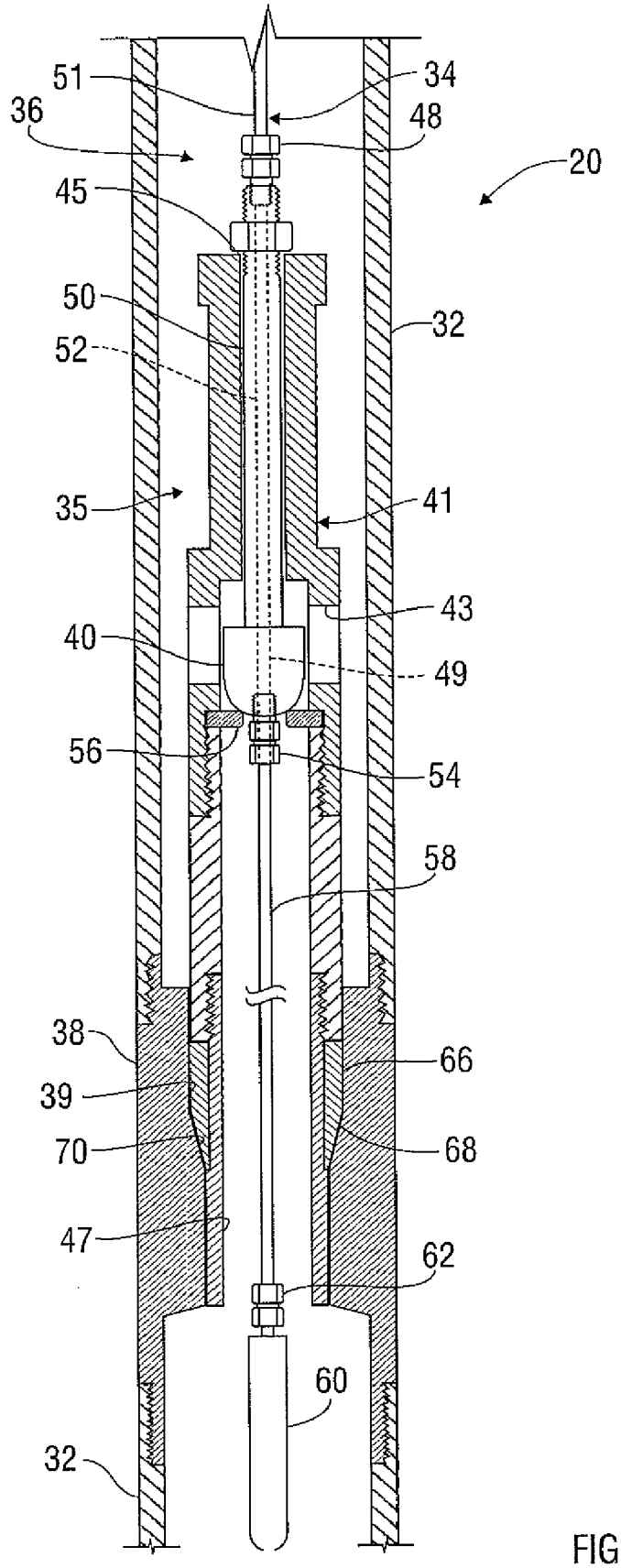
FIG. 3 is a partial cross-sectional view of another embodiment of an injection system in accordance the present disclosure.

In this example, the outer surface of the housing 41 includes a plurality of annular grooves 44 at the lower end thereof. Seals 46 may be placed inside the grooves 44 for sealing between the outer diameter of the housing 41 and the nipple 38, thereby essentially sealing off the dead string 32. The seals 46 may be made using any variety of suitable materials such as, for example, Teflon. Although three seals 46 are shown, more or less seals 46 may be included as necessary for the given downhole pressure environment or other reasons. It should be noted, however, that any other suitable mechanism and technique for forming a fluid seal between the housing 41 and seat nipple 38 may be used. For example, in the embodiment of FIG. 3, the housing 41 instead includes an engagement portion 66 having a conical, or tapered, outer surface 68 which sealingly engages a correspondingly tapered portion 37 of the bore 39 of the nipple 38. The illustrated engagement portion 66 is a metal (such as brass) sleeve that forms a metal-to-metal seal with the wall of the bore 47. Accordingly, the components and techniques for releasably landing and sealing the injection system 36 relative to the hydrocarbon recovery system 20 are not limiting upon the present disclosure.

Referring again to the embodiment of FIG. 2, the housing 41 may have any suitable components, configuration and operation. The illustrated housing 41 includes an upper opening 45, a central bore 47, a seat 56 extending into the bore 47 and at least one side vent 43 located proximate to its upper end. At its upper end, the central bore 47 is in fluid communication with the bore 39 of the nipple 38 and, ultimately, the production tubing 22 (FIG. 1) via the vents 43, and with the dead string 32 at its lower end. A valve member 40 is shown disposed within the bore 47 of the housing 41 above the seat 56 with which it is sealingly engageable. The valve member 40 is driven by a stem 50, which extends through and is movable within the upper opening 45 of the housing 41.

The illustrated valve member 40 and stem 50 may have any suitable construction, configuration and operation. For example, the valve member 40 may be a ball, or partial ball, type member and the stem 50 may be a fishing neck, as are and become known in the art. The exemplary valve member 40 and stem 50 include respective central bores 49, 52 for fluid communication with the delivery tubing 34.

The housing 41, valve member 40 and stem 50 may together comprise a standing valve and may be constructed of commercially available components, such as the presently known H-F Tubing Test Valve by Harbison Fisher. Further, the valve function of the housing 41 may be used for any desired purpose, as is or becomes known. In the example of FIG. 2, the housing 41 co-acts with the valve member 40 to provide a fluid drain, or hydrostatic pressure relief, function during retrieval of the injection system 36. This feature may be especially useful to assist in removal of the injection system 36 when the stopper 35 is landed deep within the well bore 21 (e.g. FIG. 5). In fact, this feature may be instrumental in retrieving the injection system 36 at depths of 3,000 feet or more.

Figure 4:
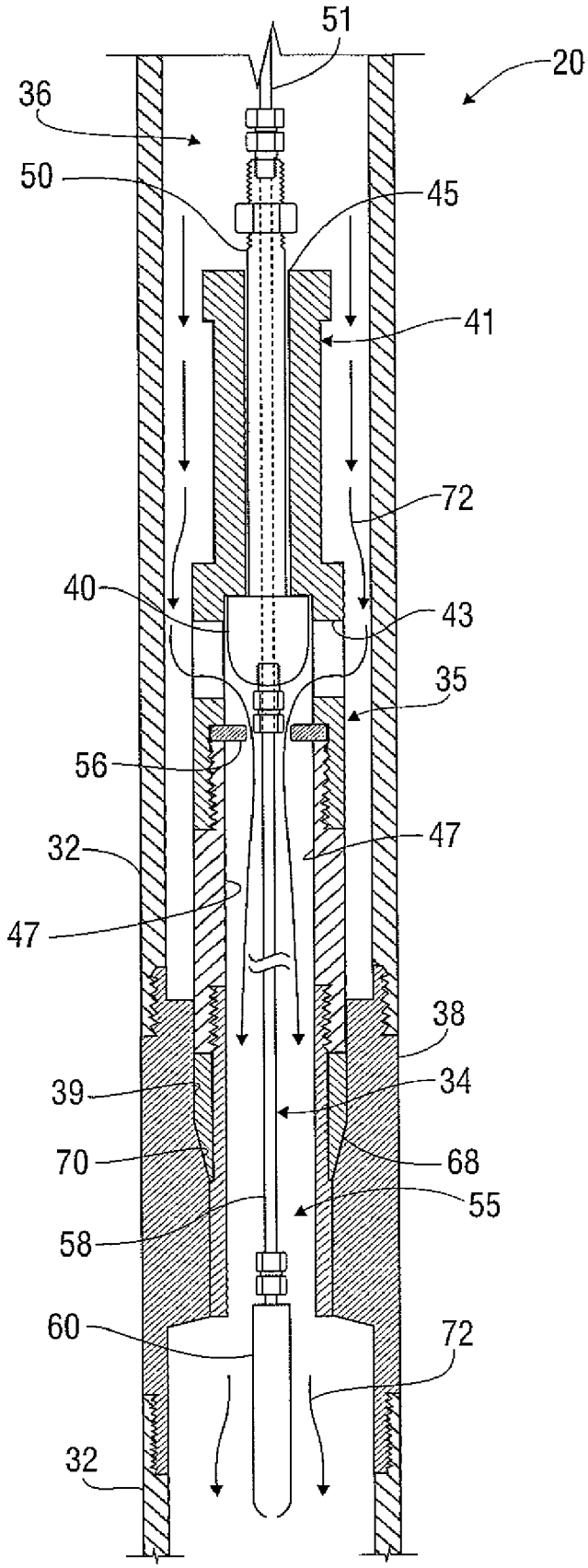
FIG. 4 is a partial cross-sectional view of the exemplary injection system of FIG. 3 having an exemplary drain valve shown in an open position in accordance with an embodiment of the present disclosure.

Still referring to the embodiment of FIG. 2, when the injection system 36 is engaged with the hydrocarbon recovery system 20 in the well bore 21 (FIG. 1), the valve member 40 is biased in a closed position. In the closed position, the valve member 40 essentially seals the bore 47 of the housing 41, assisting in sealing off the dead string 32 from the production tubing 22. (See also, e.g. FIG. 3). When desired, the illustrated valve member 40 is movable from a closed position to an open position with the application of pulling force upon the stem 50. In the open position, the valve member 40 allows fluid drainage from inside the production tubing 22 above the stopper 35 down through the vents 43 of the housing 41, into the bore 39 of the nipple 38 and into the dead string portion 32. For example, in FIG. 4, the illustrated valve member 40 is shown in an open position and the path of the draining fluid is shown with arrows 72. However, any other suitable valve or drain techniques or components may be used. Further, in some embodiments, a valve or drain capability may not be included. For example, in the embodiment of FIGS. 6-8, the stopper 35 includes a plug 74 that sealingly engages and seals off the bore 47 of the housing 41, such as with the use of one or more O-ring seal 78 or other suitable arrangement.

Referring again to FIG. 2, the delivery tubing 34 may be engaged with the stopper 35 and injector 50 (when included) in any suitable manner and with any desired components. In this embodiment, a first, or upper, section 51 of the tubing 34 is coupled to the top of the stem 50 of the valve member 40. This connection can be, for example, with the use of an NPT X compression fitting 48. A second, or lower, section 58 of the tubing 34 is coupled to the bottom of the valve member 40, such as with a compression fitting 54, thereby establishing fluid communication with the first section 51 of the tubing 34 through the respective bores 49, 52 of the valve member 40 and stem 50. This connection can also be, for example, with the use of an NPT X compression fitting 48.

Figure 6:
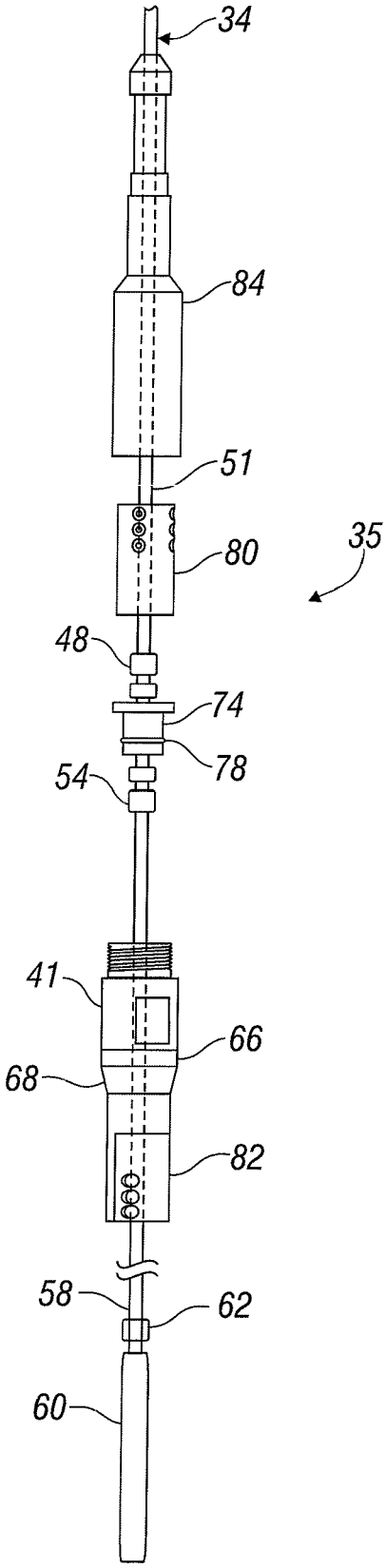
FIG. 6 is an isolated view of another embodiment of an injection system in accordance with the present disclosure shown before final assembly.
Figure 7:
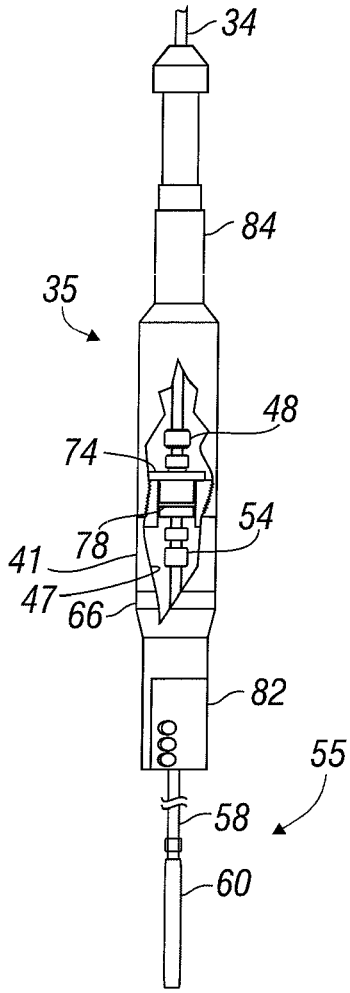
FIG. 7 is a partial cut-away view of the exemplary injection system of FIG. 6 shown assembled.

In the example of FIG. 6, the first and second sections 51, 58 connect directly to the plug 74. An upper slip 80 is shown engaging the first section 51, while a lower slip engages the second section 58. A fishing neck 80 threadably connects with the housing over the plug 74, retaining the various components in generally fixed relationship to each other. In both embodiments, the first section 51 of tubing 34 may extend to the surface and fluidly communicate with a chemical (or other fluid, fluid/particle mixture etc.) supply source (not shown) and the second section 58 connects to the injector 60, such as with another NPT X compression fitting 62. Upon retrieval of the injection system 36 from the well bore 21, in both examples, the second section 58 can be switched out to vary the target deployed location of the injector 60 and fluid injection point within or below the dead string portion 32. (This is also possible with embodiments that do not include an injector 60.)

In other embodiments, although now shown, the injector 60, or fluid injection point(s) (not shown) of the delivery tubing 34, may be placed attached above the stopper 35. In such instance, a compression fitting may be needed for both the upper and lower ends of the injector 60. For example, the upper compression fitting (not shown) could attach to the first section 51 of delivery tubing 34, while the lower compression fitting (not shown) would attach to another section of delivery tubing, which in turn will be connected to the compression fitting 48.

An embodiment of a method of operation in accordance with the present disclosure will now be described with reference to the examples of FIGS. 1 and 2. However, neither this embodiment nor other methods of the present disclosure are limited to use with the illustrated components; any suitable components or physical embodiments may be used. After the casing 26 has been run down hole, the hydrocarbon recovery system 20 may be run into the well bore 21. This includes, in this example, running the production tubing 22, perforated section or sub 24, seat nipple 38 and dead string portion 32. The injection system 36 is run inside the tubing 22 and the stopper 35 is landed in the seat nipple 38, plugging off and sealing the dead string portion 32. In this embodiment, once the stopper 35 has been landed, it will seal off the lower section of the hydrocarbon recovery system 20, thereby effectively creating the dead string by fluidly isolating the dead string portion 32, simplifying the sealing process. Once the system 36 is in place, hydrocarbon fluid production may begin.

Should the need arise to treat the perforations 28 or for any other purpose, chemicals or other desired fluid may be communicated down hole via the delivery tubing 34 and injector 60. In the case of treatment chemicals, since they are injected via the injector 60 below the stopper 35, the chemicals should move along flow path 29 (FIG. 1) down through the dead string 32, sweeping across and effectively treating the perforations 28 and flowing back up through the sub perforations 30 into and up the production tubing 22. If desired, the chemicals may be used to also treat the production tubing 22 during that return flow.

It should be noted that the length of the tubing 34 may be selected to target the injection point within or below the dead string 32. In FIG. 5, for example, the tubing 34 is sized to position the injector 60 at the lower end of the dead string 32 and, in the embodiment of FIG. 8, below the lower end of the dead string 32. The flow path of the injected fluid, in each instance, is shown with arrows 29.

Referring again to the example of FIGS. 1 and 2, in the event of a need to remove the delivery tubing 34 or the injection system 36, an overpull may be applied to the delivery tubing 34. Once overpulled, the stopper 35 will be removed from the seat nipple 38 and, along with the tubing 34 and injector 60, may then be pulled uphole through the production tubing 22 and back to the surface. Well pressure during retrieval may be controlled using a capillary surface snubbing unit, as is and becomes known by those skilled in the art. Disengagement of the stopper 35 and extraction of the injection system 36 opens the bore of the dead string portion 32 to the production tubing 22, allowing other down hole operations, if desired. Thereafter, the system 36 may be reinstalled into the hydrocarbon recovery system 20.

With the use of the embodiment of FIG. 2, before the injection system 36 is removed, if desired, hydrostatic pressure upon the system 36 may be relieved. In this example, sufficient overpull is applied to draw the stem, or fishing neck, 50 of the valve member 40 up a limited distance (e.g., 2 inches) to lift the valve member 40 from the seat 56. This will allow fluid to drain from the production tubing 22 and seat nipple 38 above the stopper 35 into the vents 43, past the valve member 40 and the seat 56, into the bore 39 of the nipple and into the dead string 32. This drain feature may be especially useful when the stopper 35 and injector 60 are located deep within the well bore 21. In fact, this feature may facilitate the and retrieval of the injection system 36 at depths of 3,000 feet or more without having to remove the production tubing 22 from the well bore 21, kill the well or employ a work-over rig.

This exemplary method of the present disclosure alleviates the need to remove the entire production tubing 22 and dead string 32 in order to access the well bore 21 and components of the hydrocarbon recovery system 20 and injection system 36. For example, upon removal of the injection system 36, the second section 58 of delivery tubing 34 may be switched out and replaced with a shorter or longer section 58 to facilitate the injection of fluid through the injector 60 at a different location within or below the dead string portion 32 after the system 36 is redeployed. As such, the present disclosure will allow for a through-tubing operation that is easily removed and replaced, thereby greatly reducing the required hardware and expense associated with such operations. Further, in accordance with this exemplary method, since the injection system 36 is run inside the production tubing 22, the deficiencies associated with strapping may be alleviated. By attaching the stopper 35 and injector 60 to the bottom end of the delivery tubing 34, the production tubing 22 may be snubbed live.

Preferred embodiments of the present disclosure thus offer advantages over the prior art and are well adapted to carry out one or more of the objects of this disclosure. However, the present invention does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. Apparatus useful for providing fluid into a subterranean well through a hydrocarbon recovery system deployable in the well, the hydrocarbon recovery system including at least one production tubing and at least one dead string portion associated therewith, the dead string portion being positioned below the production tubing, the production tubing and dead string portion each having at least one bore extending longitudinally therethrough, the production tubing including at least one perforated portion that allows the entry of fluids into the bore of the production tubing from the well when the production tubing is deployed in the well, the apparatus comprising:

an injection system releasably engageable with the hydrocarbon recovery system and configured to be movable into and out of the well and the production tubing at least substantially independent of movement of the hydrocarbon recovery system, said injection system including at least one delivery tubing having an upper end, a lower end and an outer diameter that is smaller than the inner diameter of the production tubing and dead string portion, said delivery tubing being in fluid communication with a fluid supply source, and at least one stopper connected with said delivery tubing and configured to prevent fluid flow between the respective bores of the production tubing and dead string portion when said injection system is engaged with the hydrocarbon recovery system, said at least one stopper including at least one drain valve, wherein at least one said delivery tubing extends a desired distance below said stopper and is configured to allow fluid to be ejected therefrom at a location within the dead string portion or below the dead string portion when said injection system is engaged with the hydrocarbon recovery system in the well, wherein when the hydrocarbon recovery system is deployed in the well, said injection system may be engaged and disengaged with and removable from the hydrocarbon recovery system without removing the hydrocarbon recovery system from the well, and wherein disengagement of said injection system from the hydrocarbon recovery system allows fluid communication between the production tubing and the dead string portion.

2. The apparatus of claim 1 wherein when said injection system is engaged with the hydrocarbon recovery system in the well, said drain valve is biased in a closed position and movable from a closed position to an open position by application of pulling force thereto.

3. The apparatus of claim 2 wherein said drain valve in said open position allows fluid flow from the bore of the production tubing into the bore of the dead string portion, reducing hydrostatic pressure on said injection system to ease removal of said injection system from the well.

4. The apparatus of claim 1 wherein said stopper includes a housing assembly releasably sealing engageable with the hydrocarbon recovery system, said housing assembly having at least one bore through which at least one said delivery tubing extends or fluidly communicates, said bore of said housing assembly being in fluid communication with the respective bores of the production tubing and dead string portion.

5. The apparatus of claim 4 wherein said stopper includes a plug interconnected with said delivery tubing and sealing engageable within said bore of said housing assembly, said plug being capable of assisting in fluidly isolating the respective bores of the production tubing and dead string portion when said plug is sealing engaged within said housing assembly.

6. The apparatus of claim 4 wherein said at least one drain valve is disposed at least partially within said housing assembly and moveable between open and closed positions relative to said bore of said housing assembly.

7. The apparatus of claim 4 wherein said housing assembly is releasably sealingly engageable with a seat nipple disposed within one among the production tubing and the dead string portion.

8. The apparatus of claim 7 wherein said seat nipple includes a bore and said housing assembly includes at least one among at least one non-metallic seal and at least one metal sealing surface extending at least partially around its outer diameter and being engageable within said bore of said seat nipple.

9. The apparatus of claim 7 wherein when the dead string portion has an outer diameter that is not greater than the outer diameter of the production tubing, said seat nipple may be disposed at any desired location along the length of the dead string portion.

10. The apparatus of claim 9 wherein when the hydrocarbon recovery system is deployed in the well, said fluid delivery system may be engaged with the hydrocarbon recovery system at least 3,000 feet down hole of the perforated portion of the production tubing.

11. The apparatus of claim 1 wherein when the hydrocarbon recovery system and said fluid delivery system are deployed in the well, said lower end of at least one said delivery tubing may be disposed at least 3,000 feet down hole of said stopper.

12. The apparatus of claim 1 wherein said injection system is configured so that removal thereof allows said injection system or a portion thereof to be repaired, replaced, maintained and reconfigured without any among removing the production tubing from the well, killing the well and employing a work-over rig.

13. The apparatus of claim 12 wherein said injection system is configured so that removal thereof allows at least part of said fluid injection tubing to be replaced to change the deployed position of said lower end of at least one said delivery tubing and the location of fluid ejection therefrom relative to the dead string portion of the hydrocarbon recovery system without any among removing the production tubing from the well, killing the well and employing a work-over rig.

14. The apparatus of claim 13 further including at least one injector connected to said delivery tubing proximate to said lower end thereof and configured to be positioned at a desired location within the dead string portion or below the dead string portion when said injection system is engaged with the hydrocarbon recovery system, said injector being capable of ejecting fluid from said delivery tubing at a desired location within or below the dead string portion.

15. The apparatus of claim 12 wherein said injection system is configured so that removal thereof from the hydrocarbon recovery system allows the insertion of equipment into the production tubing and dead string portion without removing the production tubing from the well, killing the well or employing a work-over rig.

16. The apparatus of claim 15 wherein said injection system is configured so that removal thereof allows any among a gage ring run, production logging and total depth tagging to be performed in the well without any among removing the production tubing from the well, killing the well and employing a work-over rig.

17. The apparatus of claim 1 wherein the perforated portion of the production tubing is a perforated sub, the dead string portion has an outer diameter that is greater than the outer diameter of the production tubing and said stopper includes a plug.

18. The apparatus of claim 1 further including at least one equipment item carried by at least one said delivery tubing and disposed proximate to said lower end thereof, said at least one equipment item including at least one among a fiber optics device, electrical conductor, gage and sensor.

19. The apparatus of claim 1 wherein said delivery tubing includes first and second portions of coiled tubing and further including an injection mandrel connected to said delivery tubing proximate to said lower end thereof and configured to be positioned at a desired location within the dead string portion or below the dead string portion when said injection system is engaged with the hydrocarbon recovery system, said injection mandrel being capable of ejecting fluid from said delivery tubing at a desired location within or below the dead string portion.

20. A chemical injection system capable of providing chemicals into a subterranean well having at least one interconnected production tubing, perforated sub, dead string and landing nipple deployed therein, each of the production tubing, perforated sub, dead string and landing nipple having at least one bore extending longitudinally therethrough, the chemical injection system comprising:

at least one upper capillary tubing in fluid communication with a chemical supply source;

at least one stopper associated with said upper capillary tubing, releasably sealingly engageable within the landing nipple and capable of releasably fluidly isolating the respective bores of the production tubing and dead string, said at least one stopper including a drain valve;

at least one lower capillary tubing in fluid communication with said upper capillary tubing and extending below said stopper, said lower capillary tubing being configured to be at least partially insertable into the bore of the dead string; and at least one injector disposed at or proximate to the lower end of said lower capillary tubing and in fluid communication therewith, said injector being positionable, and capable of ejecting chemicals supplied through said upper and lower capillary tubings below the upper end of the dead string, said upper and lower capillary tubings, stopper and injector being interconnected and together insertable into and removable from the well and the bore of the production tubing without removing the production tubing from the well.

21. The chemical injection system of claim 20 wherein said injector is positionable and capable of ejecting chemicals at any desired location within the bore of the dead string.

22. The chemical injection system of claim 20 wherein said injector is positionable and capable of ejecting chemicals below the lower end of the dead string.

23. The chemical injection system of claim 20 wherein said stopper includes a plug.

24. Apparatus useful for providing fluid into a subterranean well through a hydrocarbon recovery system deployable in the well, the hydrocarbon recovery system including at least one production tubing and at least one dead string portion associated therewith, the dead string portion being positioned below the production tubing, the production tubing and dead string portion each having at least one bore extending longitudinally therethrough, the production tubing including at least one perforated portion that allows the entry of fluids into the bore of the production tubing from the well when the production tubing is deployed in the well, the apparatus comprising:

an injection system releasably engageable with the hydrocarbon recovery system and configured to be movable into and out of the well and the production tubing at least substantially independent of movement of the hydrocarbon recovery system, said injection system including at least one delivery tubing having an outer diameter that is smaller than the inner diameter of the production tubing and dead string portion, said delivery tubing being in fluid communication with a fluid supply source, and at least one stopper connected with said delivery tubing and configured to prevent fluid flow between the respective bores of the production tubing and dead string portion when said injection system is engaged with the hydrocarbon recovery system, said at least one stopper including a drain valve, said delivery tubing being configured to allow fluid to be ejected therefrom into the production tubing at a location above the stopper when said injection system is engaged with the hydrocarbon recovery system in the well, wherein when the hydrocarbon recovery system is deployed in the well, said injection system may be engaged and disengaged with and removable from the hydrocarbon recovery system without removing the hydrocarbon recovery system from the well, and wherein disengagement of said injection system from the hydrocarbon recovery system allows fluid communication between the production tubing and the dead string portion.

25. Apparatus useful for providing equipment into a subterranean well through a hydrocarbon recovery system deployable in the well, the hydrocarbon recovery system including at least one production tubing and at least one dead string portion associated therewith, the dead string portion being positioned below the production tubing, the production tubing and dead string portion each having at least one bore extending longitudinally therethrough, the production tubing including at least one perforated portion that allows the entry of fluids into the bore of the production tubing from the well when the production tubing is deployed in the well, the apparatus comprising:

an injection system releasably engageable with the hydrocarbon recovery system and configured to be movable into and out of the well and the production tubing at least substantially independent of movement of the hydrocarbon recovery system, said injection system including at least one delivery tubing having upper and lower ends and an outer diameter that is smaller than the inner diameter of the production tubing and dead string portion, said delivery tubing capable of carrying at least one item of equipment proximate to its lower end, and at least one stopper connected with said delivery tubing and configured to prevent fluid flow between the respective bores of the production tubing and dead string portion when said injection system is engaged with the hydrocarbon recovery system, said at least one stopper including a drain valve, wherein at least one said delivery tubing extends a desired distance below said stopper and is capable of positioning the equipment carried thereby at a location within the dead string portion or below the dead string portion when said injection system is engaged with the hydrocarbon recovery system in the well, wherein when the hydrocarbon recovery system is deployed in the well, said injection system may be engaged and disengaged with and removable from the hydrocarbon recovery system without removing the hydrocarbon recovery system from the well, and wherein disengagement of said injection system from the hydrocarbon recovery system allows fluid communication between the production tubing and the dead string portion.

26. The apparatus of claim 25 wherein at least one said delivery tubing is in fluid communication with a fluid supply source and is configured to allow fluid to be ejected from said delivery tubing at a location within the dead string portion or below the dead string portion when said injection system is engaged with the hydrocarbon recovery system in the well.

27. The apparatus of claim 25 wherein the at least one equipment item carried by said delivery tubing includes at least one among a fiber optics device, electrical conductor, gage and sensor.

28. The apparatus of claim 25 wherein said stopper includes a housing assembly releasably sealingly engageable with the hydrocarbon recovery system, said housing assembly having at least one bore through which at least one said delivery tubing extends or fluidly communicates, said bore of said housing assembly being in fluid communication with the respective bores of the production tubing and dead string portion.

29. The apparatus of claim 25 wherein said at least one drain valve is disposed at least partially within said housing assembly and moveable between open and closed positions relative to said bore of said housing assembly.

30. A method of providing chemicals into a subterranean well having a hydrocarbon recovery system disposed therein, the hydrocarbon recovery system including at least one interconnected production tubing, dead string portion and seat nipple, the dead string portion being disposed down hole of the production tubing, the production tubing, dead string portion and seat nipple each having a bore extending longitudinally therethrough, the production tubing including at least one perforated portion or sub that allows the entry of fluids into the bore of the production tubing from the well, the method comprising:

inserting an injection system into the production tubing from the surface, the injection system including at least one delivery tubing and stopper and having at least one fluid ejection point located below the stopper;

at least substantially simultaneously seating the stopper within the seat nipple, fluidly isolating the respective bores of the production tubing and dead string at the location of the stopper, and positioning at least one fluid ejection point at a desired location either within the bore of the dead string or below the lower end of the dead string;

ejecting chemicals from the delivery tubing at at least one the fluid ejection point at a desired location either within the bore of the dead string or below the lower end of the dead string;

actuating a drain valve to allow fluid communication between the respective bores of the production tubing and dead string, relieving hydrostatic pressure on the injection system; and applying an overpull to the delivery tubing and removing the injection system from the hydrocarbon recovery system and well, wherein the respective bores of the production tubing and dead string become fluidly connected and the injection system is removable from the well without removing the hydrocarbon recovery system from the well.

31. The method of claim 30 further including at least one among modifying at least one component of the injection system and conducting at least one down hole operation through the respective bores of the production tubing and dead string, reinserting the injection system back into the production tubing from the surface, at least substantially simultaneously seating the stopper within the seat nipple, fluidly isolating the respective bores of the production tubing and dead string at the location of the stopper, and positioning at least one fluid ejection point of the injection system at a desired location either within the bore of the dead string or below the lower end of the dead string, and ejecting chemicals from the delivery tubing at a desired location either within the bore of the dead string or below the lower end of the dead string.

* * * * *